United States Patent [19]

Rolf

[11] 4,182,257

[45] Jan. 8, 1980

[54] RESCUE EQUIPMENT FOR SUBMARINE CRAFTS

[75] Inventor: Eckhard Rolf, Bremen, Fed. Rep. of Germany

[73] Assignee: Erno Raumfahrttechnik GmbH, Bremen, Fed. Rep. of Germany

[21] Appl. No.: 917,080

[22] Filed: Jun. 19, 1978

[30] Foreign Application Priority Data

Jun. 21, 1977 [DE] Fed. Rep. of Germany ..... 2727720

[51] Int. Cl.[2] ..... B63C 7/00

[52] U.S. Cl. ..... 114/333

[58] Field of Search ..... 9/321, 323, 327; 114/331, 333

[56] References Cited

U.S. PATENT DOCUMENTS

| | | | |
|---|---|---|---|
| 3,436,776 | 4/1969 | Davis | 114/331 X |
| 3,716,009 | 2/1973 | Strickland | 114/333 |
| 3,942,456 | 3/1976 | Dinglinger et al. | 114/333 |

*Primary Examiner*—Charles E. Frankfort
*Assistant Examiner*—James B. Bechtel
*Attorney, Agent, or Firm*—Smyth, Pavitt, Siegemund, Jones & Martella

[57] ABSTRACT

An auxiliary gas source for blowing a ballast tank of a submarine craft includes a casing with a store for pressure gas, a container for liquid and a gas generator proper into which the liquid can be forced by the gas. The liquid is contained in a flexible bag and the pressure gas acts on the bag from the outside, to be separately discharged as a supplemental supply of gas.

1 Claim, 2 Drawing Figures

RESCUE EQUIPMENT FOR SUBMARINE CRAFTS

BACKGROUND OF THE INVENTION

The present invention relates to rescue equipment for submarine crafts wherein a chemical reaction or a catalytic decomposition of a liquid produces gas which establishes the or additional static lift.

U.S.-Letters Pat. No. 3,942,456 discloses such a rescue equipment which includes a plurality of gas generators being preferably disposed in the ballast tanks of the submarine craft in order to blow these tanks when the need arises. The gas generators in particular provide gas by chemical reaction and/or by catalytic decompositioning, and the generated gas blows the tanks to obtain the requisite buoyancy permitting, hopefully, that the possibly disabled vehicle can still surface. In accordance with this particular patent, one provides a plurality of such gas generators and operates them in a number corresponding to the particular depth from which the craft is to surface. The particular equipment includes particularly equipment for automatically selecting the number of generators to be activated in dependence upon the depth of the craft when the need arises. As a particularly advantageous embodiment, gas generators are described in this patent in which the liquid reactant is forced into and through a catalyst under pressure to obtain the catalytic reaction and decompositioning. Equipment of the type disclosed in the above-identified patent has actually been used and found operational and adequately functioning.

It was found, however, that after a successful surfacing of the submarine craft, it may be necessary to blow additional gas into the tanks because the gas resulting from the chemical reaction or catalytic decompositioning cools after filling the tank and that cooling reduces its volume. Also, one or the other components resulting from the reaction or the decompositioning may be water soluble and may mix to some extent with the water in the ballast tank, and again, the resulting effective gas volume produced is less than what is expected. Moreover, the vessel may vibrate, shake or undergo other irregular movements resulting in a partial discharge of the gas from the tanks without adequate replacement.

DESCRIPTION OF THE INVENTION

It is an object of the present invention to provide a new and improved rescue equipment in which individual gas generators provide gas through chemical reaction or decompositioning of a liquid for purposes of blowing ballast tanks, in which after such a generator has exhausted its supply, it is still possible and without extensive supplement, to cause such a generator to furnish an additional quantity of gas, at least on a limited basis.

In accordance with the preferred embodiment of the present invention, it is suggested to use a flexible bag as the immediate container for a liquid reactant, and the interior of that bag is or is made to communicate with a gas generator proper through which and from which the generated gas is discharged into a ballast tank for purposes of blowing same. The liquid is discharged from the bag by discharge of pressurized gas from a gas container, which is made to communicate with the space between a rigid wall container and the flexible bag contained therein. The gas from the pressure source, after having fulfilled the function, will occupy the interior of the rigid wall container, and the flexible bag has collapsed and discharged its content. Now, through a separately controllable outlet, that pressurized gas in the rigid wall container can be discharged additionally and separately into the ballast tank to supplement the blowing action of the principal reaction gas but independently therefrom and whenever such supplement action is needed.

It can, thus, be seen that the pressure gas which empties the bag and has forced the liquid through the reactor, is not made to follow immediately the gas as generated into the ballast tank but is temporarily maintained, partially in its original storage facility and partially in the container which originally contained the bag holding the liquid. Rather, that gas is and can be made available through a separately controllable outlet whenever such an additional supply of gas is needed. On the other hand, no additional facilities are needed to obtain this supplemental action.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
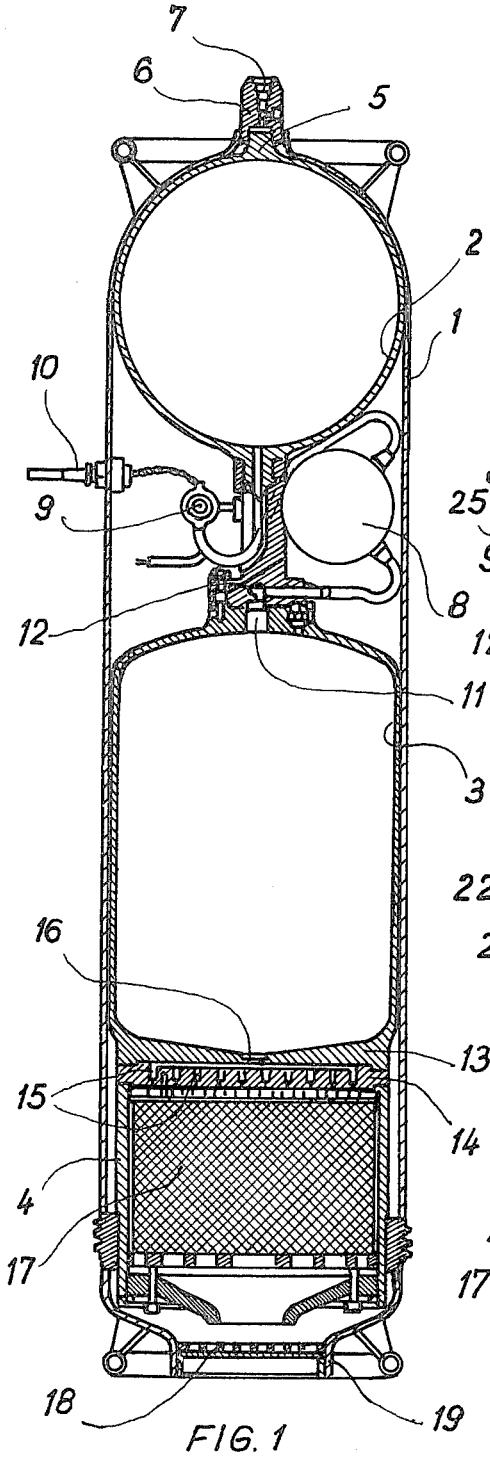
FIG. 1 is a section view of a single unit gas generator of the type disclosed in U.S.-Letters Pat. No. 3,942,456.

The two containers 2 and 3 are interconnected by a pressure regulator 8, and a valve 9 is provided between balloon 2 and the regulator 8. Valve 9 should be contructed as pyrotechnical valve, and is operated electrically from the outside by means and through a signal running through the electrical cable 10.

The storage tank 3 for the liquid has an inlet 11 closed by a burst or rupture disk 12 which breaks under pressure when valve 9 is opened and subjects disk 12 to the pressure of tank 2. The discharge opening 13 of tank 3 is connected to a distributor and aperture disk 14 having a plurality of injection openings 15. A rupture disk 16 is disposed above disk 14 and normally separates the container 3 from generator 4. Disk 16 constitutes the bottom of container 3. Upon distruction of disk 16 under pressure liquid from container 3 is forced into generator 4. However, the normal pressure of the liquid in tank 3 is insufficient to rupture disk 16.

The generator 4 includes a catalytic material 17 which decomposes the liquid injected from tank through openings 15. The pressurized gas once developed will destroy another rupture disk 18 disposed across the bottom opening 19 of casing 1. Upon rupture of disk 18, the gas developed by generator 4 can be discharged through opening 19. If the gas generator is disposed directly inside of a ballast tank, no further connections are needed, the gas can flow or be forced out of openings 19 directly into the ballast tank to cause removal of water therein.

Generally speaking, casing 1 has three major compartments 2, 3, and 4, which are normally separated but interconnected when the generator is triggered for operation, so that a pressure medium from the first compartment can force decomposable liquid from the second compartment to the third one for generation of gas therein.

Figure 2:
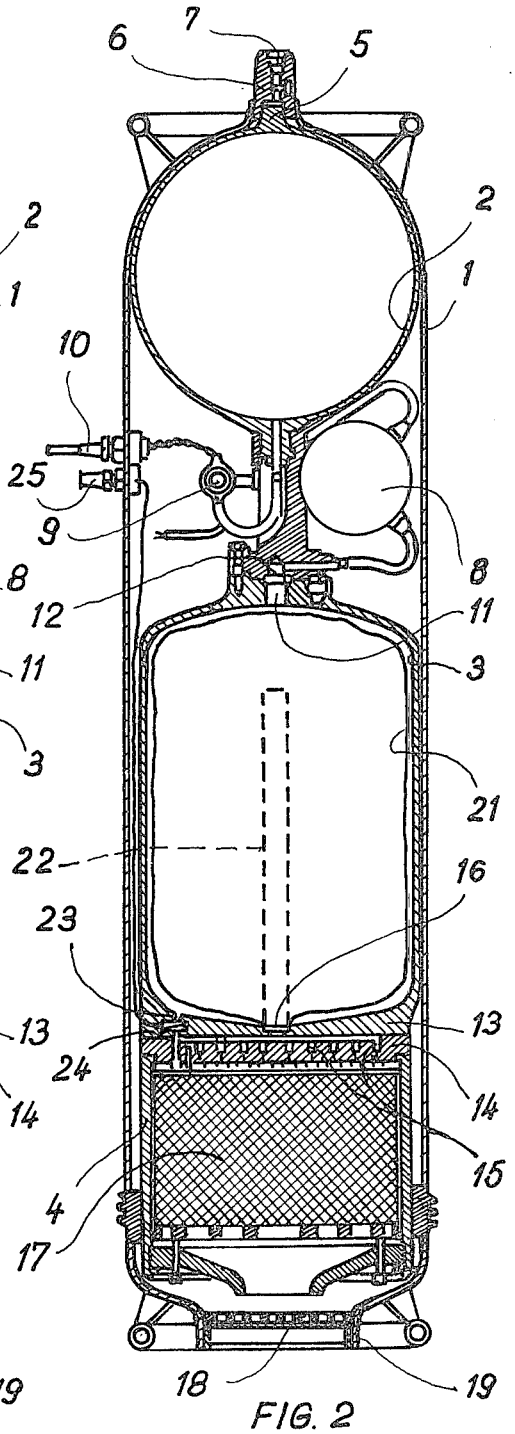
FIG. 2 is a modified gas generator in accordance with the preferred embodiment of the present invention. Proceeding now to the detailed description of the drawings, both figures show a casing 1 made of material resisting chemical reaction with seawater. Casing 1 includes and contains a balloon-shaped storage tank 2 containing a pressurized, auxiliary gas such as nitrogen. The amount of nitrogen stored here is small in comparison with the amount of gas to be developed by the particular generator. A filling nipple 5 is sealed by a screw cap 6 and a valve 7. Balloon tank 2 is provided in the upper portion of casing 1. A central portion of casing 1 contains a storage tank 3 for the liquid to be chemically decomposed for the development of gas. In other words, tank 3 contains the liquid energy carrier. The gas generator proper is a device 4 which is positioned in the lower portion of casing 1. The liquid contained in the tank 3 may be hydrazine or a hydrazine derivative and the device 4 may be a catalytic reactor.

Thus far, we have described the common features of the old and the new gas generator. We now turn to particulars of FIG. 2. The device shown in FIG. 2 is supplemented in that the rigid wall container 3 contains a flexible lining or bag 21 in which the liquid reactant is disposed. This bag 21 has an opening secured to an outlet 13. A perforated tube 22 is disposed inside of the flexible bag 21, and that tube is likewise connected to the outlet 13 in the bottom of a container 3. This particular tube 22 serves exclusively for the controlled folding and collapse of flexible bag 21. The interior of container 3, but external to bag 21, is connected to the distributor plate or disc 14 by means of a short duct 23. A valve 24 is disposed in the duct 23 and the valve is controllable from external sources running electrical signals to the valve by means of cable 25. Thus, the interior of container 3 has a separate discharge path towards reactor 4 and outlet 19.

The gas generator in accordance with FIG. 2 operates as follows. After the valve 9 has been opened in a manner described, for example, in greater detail in the above-identified patent, the pressure medium in balloon or container 2 ruptures disc 12 and enters the container 3 via the pressure regulator 8. In particular, that gas is forced in between the bag 21 and the walls of container 3. Valve 24 is closed so that the pressurized gas fills container 3 and tends to compress bag 21. This action, in turn, forces the liquid in the bag 21 to rupture disc 16 and to discharge through outlet 13, through the distributor disc 14 and the injection nozzles 15 therein into the catalyst 17. Consequently, gas is produced by the catalytic reactor 4, and that gas is used and discharged through outlet 19, to blow a tank in the vehicle. That operation has been described in great detail in the above-identified patent and the description thereof is adopted here. As far as this primary function of gas generation is concerned, it makes no difference that the liquid forced through the reactor 4 was contained in a bag rather than directly in container 3. However, it is important that the gas from balloon 2 cannot be discharged together with the liquid but remains in the container 3, outside of the bag. Therefore, the operation of the present device differs in the following. The pressure medium from balloon 2 remains in tank 3 because the bag 21 prevents such gas from likewise exiting through opening 13. Therefore, that gas is still available for further use. This use can be initiated by operation of valve 24. Upon opening valve 24, the pressurized gas can discharge from container 3 through duct 23, the catalytic reactor and the exit 19, and, therefore, is available as additional gas for the ballast tank. Valve 24 can be operated, of course, independently from the valve 9 so that this supplemental supply of gas still available after the catalytic reaction, has terminated. This additional gas can be put to use whenever needed, for example, after the reaction gases in the ballast tanks have cooled and/or have failed to blow the tank completely, or after the vessel has surfaced or in any other instance. This supplemental gas source is readily available without any substantial change in the construction of the generator. The valve 24 is of the controllable on-off variety, one may even control the discharge of this auxiliary gas supply, e.g. in steps.

The gas in the balloon 2 may have originally been stored therein under rather high pressure such as 250 bars. Such high pressure is commensurate with its primary task. After decompression, it occupies now a space in total of say, 3 cubic meters. Its pressure is still significantly higher than the pressure of any water that remains in the ballast tank. The gas when now discharging through opening 19 from the container 3, will displace at least that much oceanwater from the ballast tank and produces a corresponding additional or supplemental buoyancy. It will be recalled that the patent referred to above, operates with plural, even many such generators, and for each of them such an additional gas source is available, as per the present invention. The discharge of the auxiliary gas may be controlled individually so that this simple supplemental feature is available at a high degree of versatility.

The invention is not limited to the embodiments described above but all changes and modifications thereof not constituting departures from the spirit and scope of the invention are intended to be included.

I claim:

1. Rescue equipment for a submarine vehicle for blowing ballast tanks, comprising:

a casing having an outlet;

a first storage container for pressurized gas in the casing and having an outlet;

a second container in the casing, having an inlet and an outlet;

valve controlled conduit means interconnecting the outlet of the gas container with the inlet of the second container;

a flexible bag in the second container and containing a liquid reactant and being connected to the discharge outlet of the second container, the first container discharging gas into space between the second container and the bag upon opening of the conduit means, thereby forcing the liquid out of the bag;

a gas generator connected between the discharge outlet of the second container and the outlet of the casing to discharge generated gas based on chemical reaction or catalytic decompositioning of the liquid reactant in the bag; and second valve controlled conduit means communicating with the space between the bag and the second container to discharge therefrom pressurized gas having entered the second container after discharge from said first container.

* * * * *